US008472865B2

(12) United States Patent
Taherloo

(10) Patent No.: US 8,472,865 B2
(45) Date of Patent: Jun. 25, 2013

(54) ECHO LIGHT COMPLEX

(76) Inventor: Babak Taherloo, Copenhagen NV (DK)

( * ) Notice: Subject to any disclaimer, the term of this patent is extended or adjusted under 35 U.S.C. 154(b) by 411 days.

(21) Appl. No.: 12/805,662

(22) Filed: Aug. 12, 2010

(65) Prior Publication Data

US 2012/0038836 A1 Feb. 16, 2012

(51) Int. Cl.
*H04H 60/27* (2008.01)

(52) U.S. Cl.
USPC ..... 455/3.06; 455/414.3; 455/414.4; 455/420; 348/789; 370/312

(58) Field of Classification Search
USPC ..... 455/3.01, 3.02, 3.06, 412.2, 414.1, 455/414.4, 418, 41.2, 41.3, 552.1, 556.1, 455/566, 575.9, 99, 95, 154.2, 297, 344, 455/345, 6.3, 420; 348/789, E09.025, E05.128, 348/744, 14.01, 14.08, 14.09, 14.07; 709/219, 709/231, 246; 725/82, 104; 340/5.1, 173; 715/810; 705/10, 26, 27, 57; 370/338, 312, 370/330; 353/7, 30, 31, 85; 345/156, 611, 345/536, 467, 672
See application file for complete search history.

(56) References Cited

U.S. PATENT DOCUMENTS

| | | | | |
|---|---|---|---|---|
| 5,580,140 | A | 12/1996 | Katz et al. | |
| 2003/0144034 | A1 * | 7/2003 | Hack et al. | 455/566 |
| 2005/0125357 | A1 * | 6/2005 | Saadat et al. | 705/57 |
| 2005/0264648 | A1 * | 12/2005 | Ivashin et al. | 348/14.09 |
| 2005/0275626 | A1 * | 12/2005 | Mueller et al. | 345/156 |
| 2006/0062096 | A1 * | 3/2006 | Kerr et al. | 369/30.27 |
| 2007/0242236 | A1 * | 10/2007 | Sugiura | 353/85 |
| 2008/0309884 | A1 * | 12/2008 | O'Dor et al. | 353/7 |
| 2009/0316671 | A1 * | 12/2009 | Rolf et al. | 370/338 |
| 2010/0080163 | A1 * | 4/2010 | Krishnamoorthi et al. | 370/312 |
| 2010/0270934 | A1 * | 10/2010 | Breuer et al. | 315/160 |
| 2011/0244798 | A1 * | 10/2011 | Daigle et al. | 455/41.2 |
| 2011/0316298 | A1 * | 12/2011 | Rampersad | 296/21 |
| 2012/0013638 | A1 * | 1/2012 | Miceli | 345/611 |
| 2012/0199652 | A1 * | 8/2012 | Krener et al. | 235/377 |

FOREIGN PATENT DOCUMENTS

| | | |
|---|---|---|
| EP | 1085492 | 3/2001 |
| EP | 1085492 | 8/2002 |
| EP | 1550992 | 7/2005 |
| EP | 2133857 | 12/2009 |
| WO | W09407233 | 3/1994 |

* cited by examiner

*Primary Examiner* — Tan Trinh
(74) *Attorney, Agent, or Firm* — McGinn IP Law Group, PLLC

(57) ABSTRACT

An apparatus mounted on a vessel used for transportation, the apparatus displaying a visual media on surroundings of the vessel, and transmitting a audio signal, associated with a media being displayed and updated by a server, the apparatus including projectors mounted inside or on the vessel displaying visual media content on outside surroundings of the vessel the projectors displaying in all angles and adjusted to display in the preferred angle that is possible or preferred by users of the vessel, the projectors can be used for a same projection, having a primary function of allowing one projector to switch off, and another projector to turn on projecting, in a same place, so that the projectors are not overheated or start malfunctioning after continuously being used, the projectors can be switched off and on from a lamp, rather than shutting all of the projectors down.

10 Claims, 1 Drawing Sheet

ECHO LIGHT COMPLEX

FIELD OF THE INVENTION

The present invention relates generally to giving passengers in a vessel like trains or underground trains, a possibility to view and hear, media content, displayed on the wall or other items surrounding the vessel, and receiving the audio as a wireless signal, with personal devices, such as FM receivers.

The term vessel will throughout this document and henceforth, be used as a general term for any tool, machine, vehicle, train, vessel, ship, aircraft, and any utility used for transport, whether it be on ground, on water or in air, whether it be with passengers or without.

BACKGROUND OF THE INVENTION

The invention will be described with the reference to a moving vessel, with a projector mounted on the vessel, either on the outside or from the inside, displaying visual media content by projecting on the surroundings of the vessel, while the sound associated with the media being displayed, will be broadcasted wirelessly to users of the vessel, who can receive the sound be using wireless receivers.

It is desirable for passenger when being transported in a vessel, Ex. a transport vessel, an underground train, a ship, to view media content, on the wall or surroundings of the vessel. Many features of this invention allows the passengers, operators of vessel and media broadcasters to have an easy and user friendly access and use of the invention and its functionality.

Although projectors are in use today, they have not been in use for displaying media content on the wall or surroundings of a moving vessel, like a train passing through a tunnel. The walls which so far could not be used for media content, such as promotional, informational or marketing purposes. This is because of the difficulties to put up or maintain almost any form of advertisement or media inside these tunnels, without delaying the traffic, or other difficulties connected with this form of advertisement. With Echo Light Complex it will now be possible and much more handy. It is here important to mention that Echo Light Complex uses the existing surroundings of the vessel as the area of which it will project upon, which makes the invention and its operating range, opportunities much wider, and allows it to function in most fields of transport known today.

The idea and effort of this invention is to broadcast media, advertise, or give information to users or passengers of a vessel, and at the same time to minimize the delay and maintenance cost involved with these kind of project.

SUMMARY OF INVENTION

The present invention provides a projector which is mounted on a vessel, displaying media content on the surroundings of the vessel, and transmitting a wireless audio signal to the passengers or users of the vessel. The wireless audio signal may be transmitted by short distance FM or other available wireless transmitters. This wireless signal can then be received by the users of the vessel, using their wireless receivers, as an example they can use the FM-Radio on their cell phone.

It is worthy to mention that many steps have been taken to ensure that this system is an up to date, secure and well functioning system, allowing the passengers, vessel operators and media broadcasters to have as much control and personal preference choices as possible, without bargaining with their access, use and usability of the system.

DETAILED DESCRIPTION

Projector

Figure 1:
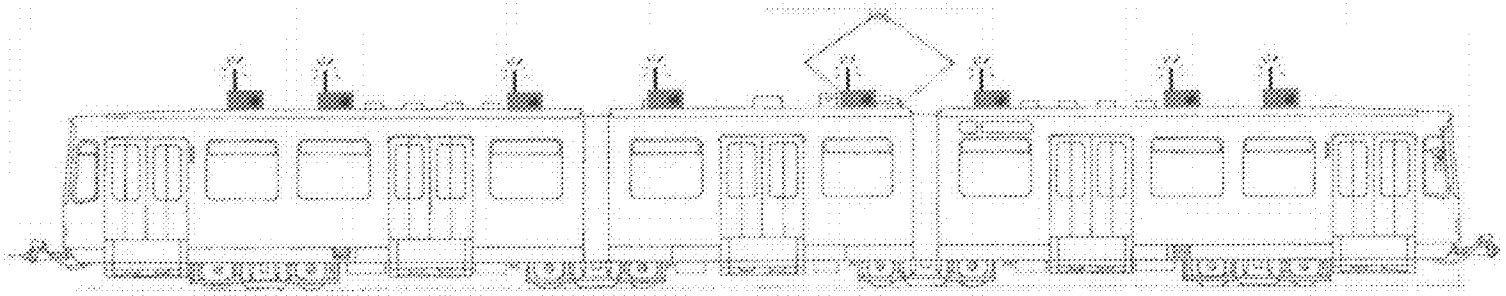
FIG. 1 is an example of the projectors mounted on a train displaying the side view of projectors mounted above the windows of the train, displaying visual media content on the surroundings of the train, allowing passengers to view this from the inside of the train.
Figure 2:
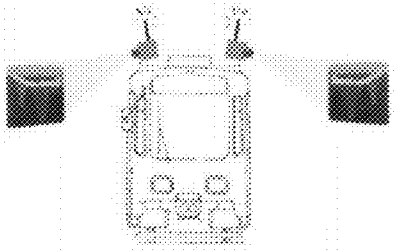
FIG. 2 is an example of the projectors displaying its visual content on the surroundings of the train. Here the train is being shown from a front view perspective.

A projector mounted on a vessel where as the term vessel throughout this document and henceforth will be used as a general term for any tool, machine, vehicle, train, vessel, ship, aircraft, and any utility used for transport, whether it be on ground, on water or in air, whether it be with passengers or without. A projector mounted on a vessel displaying visual media content on the surroundings of the vessel. The Projectors mounted on the vessels, can display in all angles (X,Y,Z) and, and can be adjusted to display in the preferred angle that is possible or preferred by the vessel users.

Multiple projectors can be used for same projection, having the primary function of allowing one projector to switch off, and another to turn on projecting in the same place, so that the projectors are not overheated or start malfunctioning because of to continuously use.

The projectors can be switched off and on from the lamp, rather then shutting the whole projector down, enabling them to start and stop fast and without shutting the whole projector off or on.

Local Server

These projectors are connected with a Local Server, which is aboard the vessel, containing the visual and audio media which is to be transmitted.

A Local Server will perform the task and function, of containing the Data, such as visual media, audio media, maintenance reports, bug reports, RSS Feeds, and other update needed. The local server will use cable or wireless connections to transfer and receive data, to the projectors, audio devices, sensors and other necessary electric devices. The Local server works together with a Central Server who will send and receive relevant Data such as the above mentioned examples, and which allows the Local servers to be controlled from one place.

Wireless Audio

An wireless audio unit will receive the audio signal from the Local Server, and transmit this to the passengers wirelessly, using the wireless technology Ex. Bluetooth, or FM or other wireless technologies, which is used by passengers, and which is available on their personal devices, Ex. cell phones, and FM receivers, allowing them to receive the audio associated with the visual media being displayed.

Cabinet

A cabinet can be used to protect and use the projectors, servers, sensors and other electronic and electrical components and devices in the open air with best possible results. This is done to guard these electronically and electric components and devices against conditions such as wind, rain, snow, heat, warm weather, cold weather, steam, dust and small air particles, oil particles, vandalism, theft etc., which in best case will decrease the quality of the systems performance and worst case cause the system to malfunction.

These cabinets will function as a general protector of the electrical and electronic components and units that needs to be placed outside the vessel. If needed these cabinets can be modified to include a cooling system, such as a refrigerator or cooling elements to keep the components inside the cabinet cold, in order to achieve best functionality and avoid malfunctions of those components. These cabinets can be modifies to include heating elements, in order to achieve best functionality and avoid malfunctions of those components. A thermostat within the cabinet can be used to control these heating or cooling mechanisms inside the cabinet. These thermostats can be adjusted manually, automatically or depending on the server model, from the central or local server by an operator.

These cabinets are constructed of various materials and in different shapes and sizes, based on the needs of the individual vessel and its geographical surroundings.

Surroundings as Screen

The entire invention will function without the use of screens for the visual projections. Instead the projections from the projectors will be projected to existing facilities around the vessel, or existing surroundings of the vessel. No measures will be taken to place any screens, since this is complicated, expensive, most often dangerous, and in many cases unrealistic to implement.

The displayed projections will as mentioned be projected on the existing surrounds, natural for the vessel, and because of the vessel moving it will even the sometimes uneven natural surfaces of the surroundings.

Central Server

The Central Server works as a communicator, that wirelessly or in some cases with wire, transfers and receives data from the Local Server. Its main task is to transfer media which is to be broadcasted from the Local Server aboard the vessel. It will also receive Data for maintainer related issues from the Local Server. Ex. if a connect is lost between the Local Server and a Projector.

On/Off Sensors

These on/off sensors primary purpose will be to switch the projectors or the projector lamps off or on based on needs. Ex. if projectors are mounted on a vessel, and reaches a station, it is required for the projectors to turn off, for the reason of not projecting directly into the eyes of passengers, and then turn on again when the train vessel have left the station. The On/Off Sensors can be placed on the route of the vessel, the vessel itself, or onboard other vessels to shut down when vessels are passing. The On/Off sensors can be of different types of sensors, based on actual needs, Ex. motion detecting sensors, Light detecting sensors, light reflecting sensors etc.

Tags

Tags can be placed along the route of the vessel, communicating with the Local Server aboard the vessel or the Central Server, and based on the geographical placement of the Tags it will broadcast appropriate media for that geographical area. The tags are based on sensors which will be placed along the track or route of the vessel and the vessel itself, and will recognize the vessels movement and current location on the track or route, and communicate this to the Local or Central Server in order for these servers to adapt and modify the media being displayed. The Tags can be sensors of different types, based on actual needs, Ex. motion detecting sensors, Light detecting sensors, light reflecting sensors.

Time Specific Media

The local servers or the central server, if directly connected to the media units, can broadcast time specific content, which is based on the specific time, that the media is being broadcasted.

Wireless Connections, Direct Central Server and Direct Central Server to Multiple Local on Same Vessel & Direct Central Server to Multiple Local on Same Vessel with Unique Receiver ID's The most easy and currently cost efficient way to decrease the amount of data and data lines, which is to be transferred wirelessly from the Central server to the Local server aboard the vessel, would preferably be to have the connection between the Central Server and the media units pass threw a local server which distributes the signals further to the media units such as projectors, wireless audio units and other units that must send or receive data in order for the system to function well.

Another way of sending and receiving the data would be the Direct Central server model.

The Direct Central Server Model, allows the central server to directly Send/receive data to a distributor which then distributes that data between all the media units aboard the vessel and the Central Server.

Further more the Direct Central Server model can be modified to include a unique ID, and using a single line connection for each vessel and the distributor on that vessel, with the difference that it will allow the distributor to sends unique data to each media units based on the unique ID of that specific Media Unit.

In the speed and with attention to the developing wireless internet connections, it is possible to make a direct connection to each media unit based on the multiple connection line for data allowing the media units to Send/Receive data from the central server independently.

Manual Update of Local Server

Another way to update the servers aboard the vessel is the manual update model. The local servers will here be manually updated by authorized personal from the local servers aboard the vessels.

They can also download informational data regarding the media units manually, such as playlet statistics, maintenance status, etc.

External. Network

The Extended Network solution can be preferable when vessels are moving threw areas, or under conditions where a connection between a central server and a local server is poor, expensive or non existing. The extended will where connection to the central server is available will update data necessary on the local servers aboard the vessel and continue its travel. When again within the range of the connection of the central server it will again update. This can either be triggered automatically when the vessel is within range of the central server connection, or be preprogrammed to update within certain areas, to certain networks.

GPS and Track Length Measuring Mechanisms

In some areas where the Echo Light Complex is to be used, it can be difficult to use tags, and On/Off Sensors, and in such cases an Gps or a Track Length measuring mechanism system can be preferable or necessary for the invention to function.

GPS measuring mechanism can be used to indicate the vessel current location, and based on preset coordinates communicate to the local or central servers to turn media units on or off, or to play media content according to the position and GPS coordinates of the vessel.

Likewise the Track Length measuring mechanism, will in some places without GPS connection, but a constant and fixed track/route which is not altered, be able to turn media units On and off, or play media content according to the measuring of the total length of the track compared to the distance the vessel have moved on the track so far.

ID

The ID unit, is a unit which users of vessel ex. passengers can use, and which allows them to connect to the media being broadcasted. The user can when entering the vessel, give the local or central server information of the seat it will use, and receive media, audio as visual media, based on the users preferences.

Such preferences can be which seat or projector the user wants to view content on, start and end destination, time on vessel. Based on a prefixed user preference, the media which is displayed can then be adjusted to fit the preference of the user, in the users time aboard the vessel. Users can also change their prefixed preferences by updating their personal prefixed preferences on the local server, whether it be a temporarily or a permanent change.

Users can either choose to manually connect to the central or local server when entering the vessel, or auto connect, or both based on the personal prefixed preferences.

The users will be able to use their personal electric devices, such as ex. Cell Phones, PC, smart phones etc., to connect to the central or local servers in order to use the ID functionality to get media based on their personal preferences.

The connection between the user and their personal electronic devices and the central or local server for ID functionality, will be established with their personal electric devices, which allows the central or local server to broadcast media with the users personal preferences, on the location where the user is located, which is identified by either user input or automatically.

The users can add, update and change their personal preferences, from their personal account from the internet or using their personal devices.

ID Even

ID even is a system allowing multiple users to share the projector, or visual media being displayed based and various variable, ex. their preferences, travel time, start and end destination.

The central or local server will then based on these variable show media content which is fairly shared between the users. It will as an example based on how many users who choose to use the same media broadcaster, how long time they will travel and their personal preferences, display media content adjusted hereto.

What is claimed is:

1. An apparatus mounted on a vessel that includes any tool, machine, vehicle, train, vessel, ship, and utility used for transportation, said apparatus displaying a visual media on surroundings of the vessel, and transmitting a audio signal, associated with a media being displayed and updated by a server, said apparatus comprising:

projectors mounted inside or on the vessel displaying a visual media content on outside surroundings of the vessel the projectors displaying in all angles (X,Y,Z) and adjusted to display in a preferred angle that is possible or preferred by users of the vessel, the projectors can be used for a same projection, having a primary function of allowing one projector to switch off, and another projector to turn on projecting, in a same place, so that the projectors are not overheated or start malfunctioning after continuously are used, the projectors being switched off and on from a lamp, rather than shutting all of the projectors down, enabling the projectors to start and stop fast and without shutting said all of the projectors off or on, the projectors being connected with a local server, which is aboard the vessel, containing a visual and audio media which is to be transmitted;

the local server that performs a task and a function of containing data such as a visual media, an audio media, maintenance reports, bug reports, rich site summary (RSS) feeds, and other update and data needed, the local server using cable or wireless connections to transfer and receive data to the projectors, audio devices, sensors and other electric devices, the local server working together with a central server that sends and receives relevant data, and allows local servers to be controlled from one place;

surrounding as screens such that the apparatus functions without using of screens for visual projections of the projectors, the visual projections projecting to existing facilities or the surroundings of the vessel;

a wireless audio unit that transmits an audio signal from the local server, wirelessly to passengers, using a wireless technology which is used by passengers on their personal electric devices including cell phones, allowing the passengers to receive an audio associated with the visual media being displayed;

a central server working works as a communicator that transfers and receives the data from the local server, the central server having a main task to transfer a media which is to be broadcasted from the local server aboard the vessel, the central server receiving data for maintenance related issues from the local server;

tags being placed along a route of the vessel, communicating with the local server aboard the vessel or the central server, and based on a geographical placement of the tags along the route of the vessel, the tags broadcast appropriate media for the geographical placement, wherein the tags are based on sensors which are placed along a track or the route of the vessel and the vessel itself, the sensor registering a movement and a current location on the track or the route, and communicating with the local server or the central server in order for the servers to adapt and modify the media being displayed, the tags comprising sensors of different types, including motion detecting sensors, light detecting sensors, and light reflecting sensors; and on/off sensors to switch the projectors or lamps of the projectors off or on, or to communicate to the central server, the local server, or the projectors, to switch the projectors on or off, the on/off sensor being placed on the route of the vessel, the vessel itself, or onboard other vessels to shut down the projectors or another equipment when said other vessels are passing the on/off sensors, the on/off sensors comprising different types of sensors, including mechanical or light based sensors, the motion detecting sensors, the light detecting sensors, the light reflecting sensors, and switches, wherein the local servers or the central server, when directly connected to media units, broadcast a time specific content, which is based on a specific time, that the media is broadcasted.

2. The apparatus of claim 1, further comprising a global positioning system (GPS) measuring mechanism that indicates the vessel current location, and based on a preset coordinates communicate to the local server or the central servers, turns the media units on or off, or plays the visual media content according to a position and GPS coordinate of the vessel.

3. The apparatus of claim 1, further comprising a track length measuring mechanism, which in places without a global positioning (GPS) connection, but a constant and fixed track/route, turns the media units On and off, or plays the visual media content according to measuring of a total length of a track compared to a distance the vessel has moved on the track.

4. The apparatus of claim 1, further comprising an ID unit which the users of the vessel including the passengers use, and which allows the user of the vessel to connect to the media being broadcasted, a user, when entering the vessel, gives the local server or the central server information of a seat, and receives a media/audio as the visual media, based on preferences of the users.

5. The apparatus of claim 1, further comprising an ID unit comprising a system for allowing multiple users to share the projectors, or the visual media being displayed based and various variables, including preferences of the users, a travel time, start and end destination, the central server or the local servers based on the preferences of the users, the travel time, and the start and end destination showing the media content which is shared between the users.

6. The apparatus of claim 1, further comprising a manual update of the local server to mutually update the local servers aboard the vessel by authorized a personal from the local servers aboard the vessels, the authorized personal downloading informational data regarding the media units manually, including playlist statistics and maintenance status.

7. The apparatus of claim 1, further comprising a direct central server model that allows the central server to directly send/receive a data content to a distributor which then distributes the data content between all the media units aboard the vessel and the central server, the data content being transferred/received wirelessly from the central server to a distributor which further transfer/receives the data content to and from the media units, including the projectors and wireless audio units.

8. The apparatus of claim 7, further comprising a direct central server for sending and receiving the data such that the central server sends and receives the data to a single distributor, which then distributes the data to all of the local servers aboard the vessels.

9. The apparatus of claim 7, wherein the direct central server model includes a unique ID, thereby allowing a use of a single data line connection for each vessel that contains a unique ID, so that the distributor on the vessel, sends and receives the unique data to and from the central server to each media units based on the unique ID of a specific media unit.

10. The apparatus of claim 1, further comprising a cabinet to be used to protect and enable a use of the projectors and to ensure best possible results with a use of the projectors, servers, sensors and other electronic and electrical components and devices, guarding these electronic and electric components and devices against conditions such as wind, rain, snow, heat, warm weather, cold weather, steam, dust and small air particles, oil particles, vandalism, and theft, in an open air outside the vessel, which without the cabinet in a best case will decrease a quality of systems performance and in a worst case causes the systems to malfunction, wherein the cabinet includes a cooling system, including a refrigerator or cooling elements to keep components inside the cabinet cold, in order to achieve a best functionality and avoid malfunctions of the components, wherein the cabinets further includes heating elements, in order to achieve the best functionality and avoid malfunctions of the components, and wherein thermostats within the cabinet are used to control heating or cooling mechanisms inside the cabinet, the thermostats are adjusted manually, automatically or depending on a server model, from the central server or the local server by an operator, and the cabinet comprises various materials and is in different shapes and sizes, based on needs of an individual vessel and its geographical surroundings.

* * * * *